United States Patent [19]

Greve

[11] 4,399,336

[45] Aug. 16, 1983

[54] MINIATURE ROTARY SIP SWITCH FOR MOUNTING ON A PRINTED CIRCUIT BOARD

[75] Inventor: James E. Greve, South Bend, Ind.

[73] Assignee: CTS Corporation, Elkhart, Ind.

[21] Appl. No.: 305,092

[22] Filed: Sep. 24, 1981

[51] Int. Cl.[3] ..... H01H 19/10; H01H 21/18

[52] U.S. Cl. ..... 200/11 R; 200/6 R; 200/6 B; 200/6 C; 200/155 R; 200/11 K

[58] Field of Search ..... 200/155 R, 291, 252, 200/283, 284, 303, 6 R, 6 B, 6 BA, 6 BB, 5 R, 16 R, 16 C, 16 D, 11 R

[56] References Cited

U.S. PATENT DOCUMENTS

| | | | |
|---|---|---|---|
| 2,421,881 | 6/1947 | Heasty | 200/155 R |
| 3,050,604 | 8/1962 | Kusche | 200/155 |
| 3,238,315 | 1/1966 | Deasy | 200/6 BB X |
| 3,715,543 | 2/1973 | Keto et al. | 200/151 |
| 3,748,419 | 7/1973 | Torrey et al. | 200/155 R |
| 3,792,206 | 2/1974 | Purdy | 200/6 B |
| 3,900,709 | 8/1975 | Sheesley et al. | 200/6 B X |
| 3,988,555 | 10/1976 | Hooper, Jr. | 200/155 R |
| 4,015,112 | 3/1977 | Castaldo | 200/155 R |
| 4,045,637 | 8/1977 | Mongeau | 200/303 |
| 4,225,758 | 9/1980 | Kondo et al. | 200/4 |

*Primary Examiner*—J. R. Scott

*Attorney, Agent, or Firm*—Larry J. Palguta; John A. Young

[57] ABSTRACT

The rotary SIP switch (10) provides a single in-line package (SIP) having switching capabilities previously found in dual in-line packages (DIP) while providing more switch contacts in the same package area. The miniature rotary SIP switch (10) has a pair of oppositely disposed terminal and contact leafs (30) fixedly mounted in the base wall (27) of the switch housing (12), with the contact leaf portions (36) cantilevered within the interior of the switch housing (12). Lateral tabs (38) integral with the leaf contacts (36) effect equal spring loading upon a contact pin (44) disposed within an aperture (42) extending through a cylindrically shaped rotary driver (40). The contact pin (44) is free floating in the aperture (42) and self-centers when the rotary driver (40) is rotated and the ends of the contact pin (44) engage respective contact leafs (36). The rotary driver (40) has integral detent protrusions (48) for positioning the driver (40) and contact pin (44) in an open circuit position.

15 Claims, 4 Drawing Figures

MINIATURE ROTARY SIP SWITCH FOR MOUNTING ON A PRINTED CIRCUIT BOARD

DESCRIPTION

TECHNICAL FIELD

The present invention is related to the field of miniaturized switches for use with printed circuit board applications.

BACKGROUND ART

Miniature switches for use on printed circuit boards and other applications requiring miniaturized switching constructions have been typically of the kind illustrated in U.S. Pat. No. 4,352,966 issued Oct. 5, 1982, entitled "Slide Switch" and assigned to the same assignee as herein, that application being incorporated by reference. Another example of a DIP (dual in-line package) switch is Kotaka U.S. Pat. No. 4,092,504 entitled "Electrical Slide Switch with Self-Centering Flexible Contact" issued on May 30, 1978; Feaster U.S. Pat. No. 4,117,280 entitled "Miniature Switches" issued on Sept. 26, 1978; Feaster U.S. Pat. No. 4,191,867 entitled "Miniature Switches" issued Mar. 4, 1980; and Zdanys et al. U.S. Pat. No. 3,944,760 entitled "Switch Assembly Having Slider Actuator Insulating Plate Inserted Between Normally Closed Contacts" issued Mar. 16, 1976 and assigned to the same assignee as herein. All of these patents illustrate various embodiments of DIP switches utilized for various circuit board applications. Any of these DIP switch packages will require a certain amount of area of a printed circuit board, and as the switch construction contains more switch contacts per unit volume, the DIP switch will require a larger portion of board space, in addition to the space occupied by the height of the DIP switch. What has not been available is a SIP (single in-line package) switch providing at least the same number of switch contacts per unit volume as DIP switches, and preferably more switch contacts per unit volume than DIP switches of similar height. Switch constructions similar to a SIP switch are illustrated by Kalous U.S. Pat. No. 3,291,951 issued Dec. 16, 1966; Hooper, Jr. U.S. Pat. No. 3,988,555 issued Oct. 26, 1976; and Castaldo U.S. Pat. No. 4,015,112 issued Mar. 29, 1977. Although some of these patents describe small sized constructions suitable for use on a printed circuit board, none disclose a miniature SIP switch construction utilizing a free-floating, self-centering contactor element contained in a switch construction of similar unit volume.

DISCLOSURE OF THE INVENTION

The present invention comprises a SIP (single in-line package) miniature ratoray switch. The miniature rotary switch comprises a generally rectangular housing having two switches contained therein, with the switch terminals aligned in the SIP configuration. Each individual switching construction contained in the housing includes a pair of oppositely disposed terminal and contact leafs fabricated by metal stamping. Each terminal and contact leaf is secured by inserting a centrally located stake into the respective half of the housing. The terminal portion extends exterior of the housing, and the contact leaf portion is cantilevered within the interior of the switch housing. Two mounting tabs are formed perpendicular to the longitudinal plane of the terminal and contact leaf, and provides further support for the contact leaf portion in addition to providing a resistance to lateral flexing of the contact leaf. The top end of the housing has a pair of apertures, and the opposite end of the housing has a pair of recesses therein. The rotary drivers are generally cylindrical in shape, with an annular extension from one end of each driver being journalled in a recess and the opposite end of each driver journalled in an aperture in the top end of the housing. Each driver has a through aperture in which is located a free floating contact pin; the contact pin being located 90 degrees from oppositely disposed detent protrusions integral with the driver. As the driver is rotated from one switch position to another, the ends of the contact pin or the oppositely disposed detent protrusions wipingly engage the ends of the contact leaves which are formed to receive both the contact pin ends and the detent protrusions. Thus, the user receives a positive feel as the driver is rotated each 90 degrees from one switching position to another.

BEST MODE OF CARRYING OUT THE INVENTION

Figure 1:
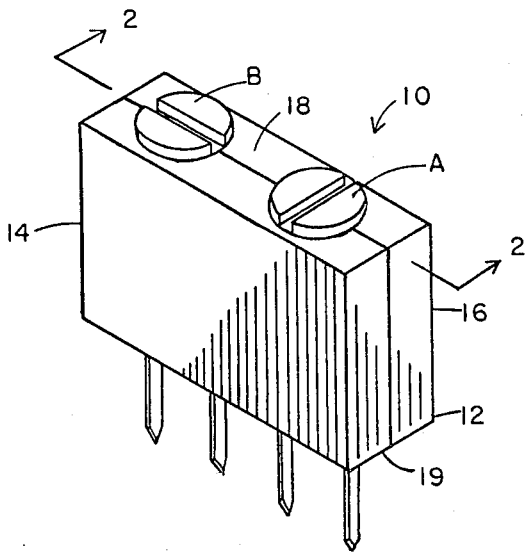
FIG. 1 is a perspective view of the miniature SIP rotary switch of the present invention.
Figure 4:
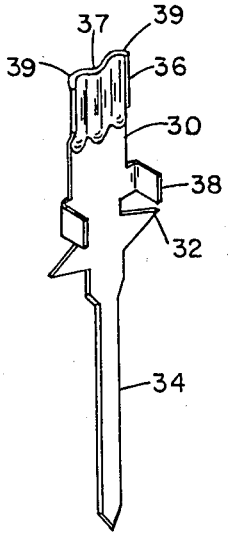
FIG. 4 is a perspective view of the terminal and contact leaf of the miniature rotary SIP switch.

Referring now to the drawings, FIG. 1 illustrates a perspective view of the miniature rotary SIP switch, designated generally by numeral 10. The rotary SIP switch 10 includes a housing 12 comprised of housing halves 4 and 16, the housing 12 being generally rectangular in shape. The top end 18 of the assembled housing 12 has a pair of through apertures 20 disposed therein, with each aperture being stepped to provide shoulders 22 in the interior of the housing. The botton end 19 of the housing 12 includes journalling recesses 24 located opposite the respective apertures 20. A plurality of one piece metallic terminal and contact leafs 30 (FIG. 4) are fixedly secured to the bottom end of the housing by mechanically inserting a stake 32 into a housing recess in the respective half of the housing and securing it thereto with an adhesive. Each terminal and contact leaf 30 includes an exterior terminal 34 that extends exterior of the housing, and a contact leaf 36 located in the interior of the housing 12. The terminal and contact leafs 30 are formed by stamping metal sheets and then forming the contact leaf 36 and lateral tabs 38. The lateral tabs are bent perpendicularly to the longitudinal plane of the terminal and contact leaf 30 and abut the inner base wall 27 of the housing 12 (see FIG. 2). The contact leaf 36 has a sinuous curved portion 37 and outwardly flaring ends 39 (FIG. 4).

Figure 3:
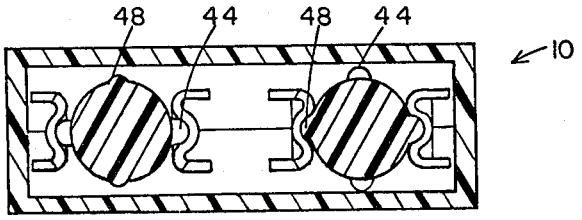
FIG. 3 is a section view taken along lines 3—3 of FIG. 2.
Figure 2:
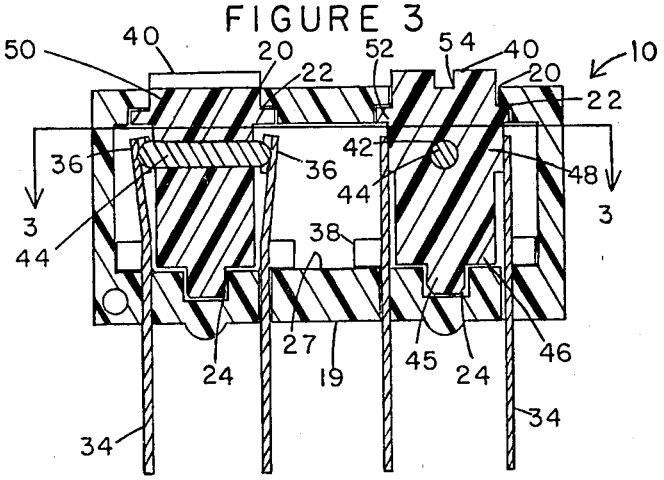
FIG. 2 is a section view taken along lines 2—2 of FIG. 1.

A pair of rotary drivers 40 are mounted in the housing 12 and each contains a through aperture 42 in which is located a free floating metallic contact pin 44 (FIGS. 2 and 3). The rotary drivers 40 are generally cylindrical in shape and have extending from end 46 a bearing extension 45 journalled in a respective recess 24. Each rotary driver 40 is molded from an electrically inert thermoplastic resin such as polypropylene, and has formed integral therewith a pair of oppositely disposed detent protrusions 48, located 90 degrees out-of-phase with the free floating contact pin 44. Located about end 50 of each rotary driver 40, is a boss 52 journalled by the complementary shoulder 22 formed in the housing 12. Driver end 50 extends above top end 18 of the housing 12 and has a tool slot 54 for receiving a tool utilized to rotate the driver 40.

OPERATION

Referring to FIGS. 2 and 3, the rotary driver 40 is mounted in the switch housing 12 by positioning the driver between the oppositely disposed terminal and contact leafs 30. The bearing projection 45 is received in the journal recess 24, and the boss 52 is journalled by shoulder 22 of the housing end 18. The detent projections 48 or the ends of the contact pin 44 are received in the curved portion 37 of the contact leaf 36. The contact leaf portion of each terminal and contact leaf is cantilevered within the interior of the switch, that is, it provides a spring load directed against either the detent protrusion 48 or contact pin end 44. The lateral tabs 38 abut the interior base wall 27 and provide resistance to enable the leaf 30 to bend and thereby provide the spring loading.

As shown in FIG. 3, the rotary driver on the right side of the switch 10 is in an "off" position, that is, the detent protrusions 48 are received by the curved portions 37 of the respective contact leafs 36. When the rotary driver 40 is rotated by inserting a tool (not shown) into the tool receiving slot 54 and applying a rotational force, the rotary driver rotates so that the detent protrusions 48 are displaced from their respective contact leafs 36 and the free floating contact pin 44 engages the contact leafs 36. Because the contact pin 44 is free floating, the pin is self-centering between the contact leafs. Additionally, there is a wiping action which prevents the build up of contaminants and corrosion between the ends of the contact pin 44 and the respective contact leafs 36. The rotary driver 40 shown in the left side of the switch 10 of FIG. 2, is in the "on" position with the free floating contact pin 44 self-centered between the contact leaf 36.

When the rotary driver 40 is rotated in either clockwide or counterclockwise direction, each 90 degrees of rotation effects a change from an "off" to an "on" switch position. The mode of the switch may be determined by observing the position of the tool opening 54 in relation to the switch housing 12. When the tool opening 54 is positioned perpendicular to the length of the housing, the switch is in an "off" mode as shown by switch A of FIG. 1, and when the tool opening 54 is aligned lengthwise with the housing 12, the switch is in the "on" mode (switch B of FIG. 1) and a circuit is completed across the respective terminals.

The free floating contact pin 44 is self-centering between the contact leafs, which effects an equal spring loading and contact alignment as the contact pin is moved into the "on" position.

The miniature rotary SIP switch may be mounted on a printed circuit board for the opening and closing of circuits therein. The switch increases the flexibility in design when the printed circuit board layout is developed, in addition to providing more switch contacts per unit volume than DIP switches of the same height, that is, there are more switch contacts contained in the same package area than would be normally provided by typical DIP switch constructions of the same or similar height. The miniature rotary SIP switch may contain as many as six switches for practical use on a printed circuit board, although a larger SIP unit containing more switches may be readily fabricated.

INDUSTRIAL APPLICABILITY

The miniature rotary SIP switch may be utilized for opening and closing circuits with a minimal amount of board area occupied by the switch.

CONCLUSION

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A miniature rotary SIP switch which maximizes the number of switch contacts per unit volume of switch package, comprising a housing having a front surface and a back surface in substantially parallel relationship and surfaces disposed between said parallel surfaces to form ends of said housing, said housing having an aperture at one end thereof and receiving means disposed oppositely from said aperture, oppositely disposed terminal and contact leaf means, each terminal and contact leaf means fixedly secured to said housing with the terminal means extending exteriorly of said housing and the contact leaf means disposed interiorly of said housing, rotary driver means having mounting means, actuation means, and laterally free-floating self-centering contact means disposed in said rotor and substantially perpendicular to the longitudinal plane of said driver, the mounting means disposed in the receiving means of said housing and the actuation means journalled in said aperture for exterior actuation of said driver whereby rotation of the driver effects biased wipable engagement of the contact means with said oppositely disposed contact leaf means to complete an electrical circuit across said terminal and contact leaf means and said contact means.

2. The miniature rotary SIP switch of claim 1, wherein said rotary driver includes detent means integral with said driver, said detent means receivable by said contact leaf means for locating said rotary driver in an open circuit mode.

3. The miniature rotary SIP switch of claim 1, wherein said actuation means includes a tool receiving slot and said actuation means extends through said aperture and exteriorly of said housing for rotation of said driver in one of clockwise and counterclockwise directions.

4. The miniature rotary SIP switch of claim 1, wherein each contact leaf means is cantilevered in the interior of said housing for flexibly receiving said contact means as said rotary driver is rotated.

5. The miniature rotary SIP switch of claim 1, wherein each contact leaf means includes lateral mounting means to effect cantilevered mounting of each contact leaf means in the interior of said housing.

6. A process for completing an electrical circuit across a miniature rotary SIP switch which maximizes the number of switch contacts per unit volume of switch package, comprising the steps of fixedly attaching oppositely disposed terminal and contact leaf means in a switch housing with the terminal means extending exteriorly of said switch housing for connection to an exterior circuit and said contact leaf means cantilevered in the interior of said switch housing, disposing laterally adjustable self-centering contactor means substantially perpendicular to the longitudinal plane of rotary driver means for self-centering movement relative to said rotary driver means, positioning the rotary driver means and contactor means within the interior of said switch housing and between said oppositely disposed contact leaf means, and rotating said rotary driver means and contactor means whereby said contactor means is resiliently captured by the oppositely disposed cantilevered contact leaf means to complete an electric circuit across said oppositely disposed terminal and contact leaf means and said contactor means.

7. The process in accordance with claim 6, including the step of disposing an integral detent means on opposite sides of said rotary driver means so that rotation of said rotary driver means effects capture of said integral detent means by respective ones of said cantilevered contact leaf means, in an open circuit mode.

8. The process in accordance with claim 7, including the step of providing lateral tab means projecting from the longitudinal plane of each terminal and contact leaf means to effect a spring loading of said contact leaf means upon said contactor means.

9. The process in accordance with claim 7, further comprising the step of defining an open electric circuit by locating detent projection means on opposite sides of said driver means for engagement with said contact leaf means.

10. The process in accordance with claim 7, wherein the rotary driver means and contactor means are rotatably mounted in said switch housing by positioning an axial projection of said rotary driver means in a housing recess.

11. The process in accordance with claim 7, further comprising the step of effecting rotational movement of said rotary driver means and contactor means by inserting a tool in a tool receiving means disposed at one end of said driver means and rotating said tool in one of clockwise and counterclockwise directions.

12. A process for making and breaking by external operation an electrical circuit by means substantially enclosed within the housing of a miniature SIP switch, comprising the steps of mounting within said housing in opposed relation cantilevered contact means each having a sinuous recess therein, disposing between said cantilevered contact means rotary driver means having a laterally adjustable self-centering contactor disposed within said rotary driver means and said driver means and contactor rotatable to effect a bending of said cantilevered contact means, rotating said driver means to effect biased wipable engagement of said contactor with the sinuous recesses of said cantilevered contact means and thereby effecting an electrical circuit across the opposed cantilevered contact means and self-centering contactor, selectively rotating said rotary driver means to effect disengagement of said contactor with said sinuous recesses of the cantilevered contact means, and engaging with said sinuous recesses electrically nonconductive detents which serve to positively position said rotary driver means.

13. The process in accordance with claim 12, including the step of capturing said rotary driver means between bearing support means located interiorly of said housing and retaining said rotary driver means while permitting relatively free rotation of said rotary driver means to effect the aforesaid making and breaking of an electrical circuit.

14. The process in accordance with claim 12, including the step of rigidifying the flexibility of said cantilevered contact means by bending integrally related tabs to rigidify the flexibility of said cantilevered contact means and confine the movement of said cantilevered contact means to resilient bending about a base wall of said housing.

15. The process in accordance with claim 12, including the step of staking said cantilevered contact means into undersized openings formed in said housing to effect positive location of said contact means in relation to said rotary driver means within the housing.

* * * * *